US006905559B2

(12) United States Patent
O'Hara et al.

(10) Patent No.: US 6,905,559 B2
(45) Date of Patent: Jun. 14, 2005

(54) NICKEL-BASE SUPERALLOY COMPOSITION AND ITS USE IN SINGLE-CRYSTAL ARTICLES

(75) Inventors: Kevin Swayne O'Hara, Boxford, MA (US); William Scott Walston, Mason, OH (US); Charles Gitahi Mukira, Greenville, SC (US); Melvin Robert Jackson, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 276 days.

(21) Appl. No.: 10/314,083

(22) Filed: Dec. 6, 2002

(65) Prior Publication Data

US 2004/0109786 A1 Jun. 10, 2004

(51) Int. Cl.[7] ..... C22C 19/05

(52) U.S. Cl. ..... 148/410; 148/428; 420/444; 420/448

(58) Field of Search ..... 148/410, 428; 420/444, 448

(56) References Cited

U.S. PATENT DOCUMENTS

| | | | | |
|---|---|---|---|---|
| 3,459,545 A | | 8/1969 | Bieber et al. | |
| 3,615,376 A | | 10/1971 | Ross | |
| 3,619,182 A | | 11/1971 | Bieber et al. | |
| 4,116,723 A | | 9/1978 | Gell et al. | |
| 4,719,080 A | | 1/1988 | Duhl et al. | |
| 4,878,965 A | * | 11/1989 | Gostic et al. | 148/404 |
| 5,173,255 A | | 12/1992 | Ross et al. | |
| 6,074,602 A | | 6/2000 | Wukusick et al. | |
| 6,331,217 B1 | * | 12/2001 | Burke et al. | 148/522 |
| 6,419,763 B1 | | 7/2002 | Konter et al. | |
| 2003/0211356 A1 | * | 11/2003 | Beers et al. | 428/680 |

FOREIGN PATENT DOCUMENTS

EP 1201778 A2 * 5/2002

* cited by examiner

*Primary Examiner*—George Wyszomierski
(74) *Attorney, Agent, or Firm*—McNees Wallace & Nurick LLC

(57) ABSTRACT

A composition of matter is about 1 to about 3 percent rhenium, from about 6 to about 9 percent aluminum, from 0 to about 0.5 percent titanium, from about 4 to about 6 percent tantalum, from about 12.5 to about 15 percent chromium, from about 3 to about 10 percent cobalt, from about 2 to about 5 percent tungsten, from 0 to about 0.2 percent hafnium, from 0 to about 1 percent silicon, from 0 to about 0.25 percent molybdenum, from 0 to about 0.25 percent niobium, balance nickel and minor elements. The composition is preferably made into a substantially single crystal article, such as a component of a gas turbine engine.

20 Claims, 3 Drawing Sheets

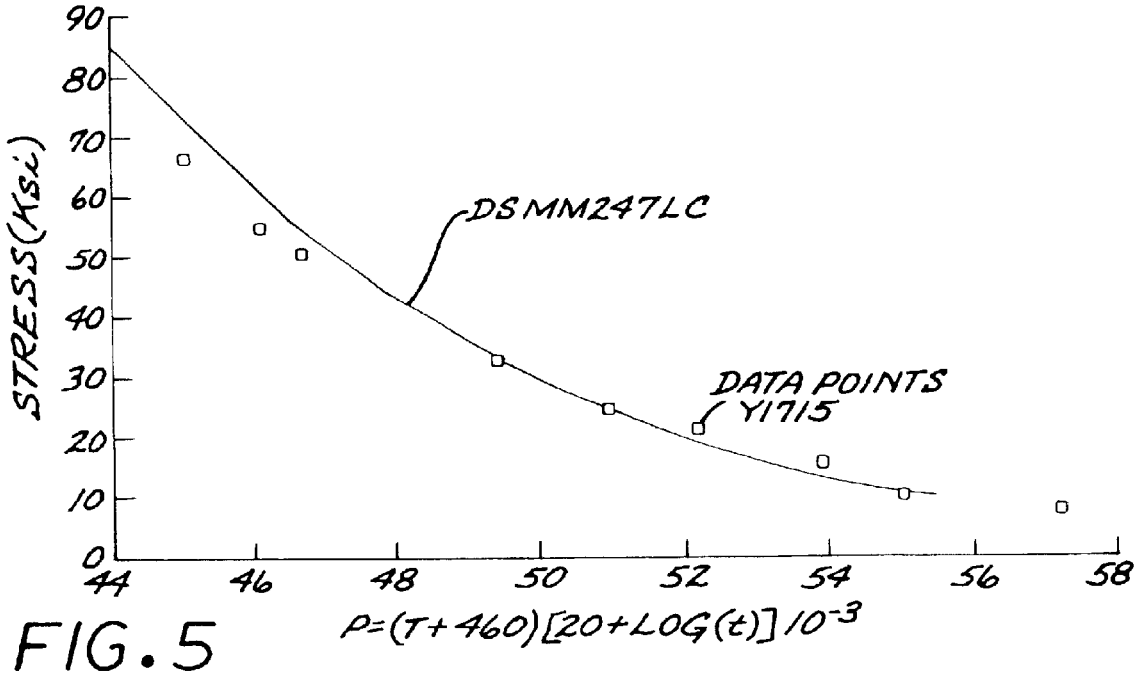
FIG. 5
FIG. 6
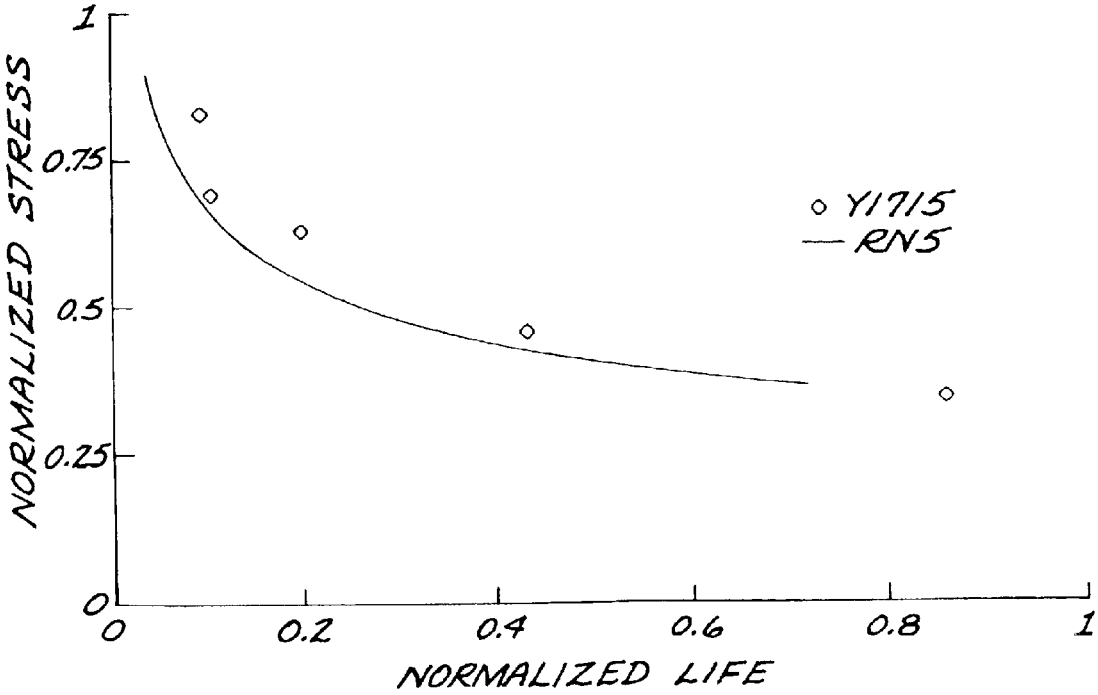

NICKEL-BASE SUPERALLOY COMPOSITION AND ITS USE IN SINGLE-CRYSTAL ARTICLES

This invention relates to the composition of a nickel-base superalloy, and to its use in articles that are substantially single crystals.

BACKGROUND OF THE INVENTION

Nickel-base superalloys are used as the materials of construction of some of the components of gas turbine engines that are exposed to the most severe and demanding temperatures and environmental conditions in the engines. For example, the turbine blades and vanes, seals, and shrouds are typically formed of such nickel-base superalloys. During service, these components are exposed to temperatures of 2000° F. or more, and also to the effects of the high-velocity flow of the hot combustion gases. To perform at this high temperature for extended periods of time and many engine cycles, the materials used in the components must have good rupture strength, a sufficiently high melting point, good thermal shock resistance, and good oxidation resistance at such high temperatures.

These components are also exposed during service to hot-corrosion attack at intermediate temperatures in the range of from about 1500° F. to about 1700° F. In this temperature range, alkali metal salts such as $Na_2SO_4$ found in the combustion gas may condense on the component and produce an accelerated, severe corrosive attack. Such alkali metal salts typically result from the ingestion of sodium chloride in sea salt and its subsequent reaction with sulfur oxides during the combustion of the fuel.

The selection of the alloy compositions of the components exposed to these different types of temperature and environmental conditions poses some difficult challenges. Elemental additions and compositions that produce good high-temperature properties often lead to unsatisfactory corrosion resistance at intermediate temperatures, and vice versa. Coatings have been developed to alleviate some of the oxidation and corrosion attack, but high-aluminum coatings may lead to phase instability in the interdiffused regions during long-term exposure at the highest temperatures.

There is an ongoing need for nickel-base superalloys and articles made from such superalloys that achieve a better combination of high-temperature and intermediate-temperature properties than available superalloys. This need is particularly acute for superalloys used to make single-crystal articles, as these articles are used at the highest temperatures. The present invention fulfills this need, and further provides related advantages.

BRIEF SUMMARY OF THE INVENTION

The present invention provides a nickel-base superalloy and articles, particularly single-crystal articles, made from the superalloy. The nickel-base superalloy achieves a good balance of physical properties, such as density, high-temperature properties, such as good rupture strength, melting point, thermal shock resistance, and oxidation resistance, and intermediate-temperature mechanical properties and hot-corrosion-resistance.

A composition of matter consists essentially of, in weight percent, from about 1 to about 3 percent rhenium, from about 6 to about 9 percent aluminum, from 0 to about 0.5 percent titanium, from about 4 to about 6 percent tantalum, from about 12.5 to about 15 percent chromium, from about 3 to about 10 percent cobalt, from about 2 to about 5 percent tungsten, from 0 to about 0.2 percent hafnium, from 0 to about 1 percent silicon, from 0 to about 0.25 percent molybdenum, from 0 to about 0.25 percent niobium, balance nickel and minor elements. The composition of matter desirably has a density of less than about 0.305 pounds per cubic inch, and most preferably less than about 0.300 pounds per cubic inch.

In a preferred embodiment of this composition, the superalloy has about 1.6 percent rhenium, about 6.6 percent aluminum, less than about 0.1 percent titanium, about 5 percent tantalum, about 13 percent chromium, about 7.5 percent cobalt, about 3.8 percent tungsten, about 0.15 percent hafnium, and less than about 0.1 percent silicon.

It is preferred in all compositions that minor elements be limited. Preferably, the composition has about 0.01 maximum percent boron, about 0.07 maximum percent carbon, about 0.03 percent maximum zirconium, about 0.01 percent maximum cerium, about 0.01 percent maximum lanthanum, about 0.04 percent maximum magnesium, about 0.001 maximum percent calcium, about 0.01 maximum percent manganese, about 0.005 maximum percent phosphorus, about 0.001 maximum percent sulfur, about 0.08 maximum percent iron, about 0.15 maximum percent molybdenum, about 0.15 maximum percent niobium, about 0.2 maximum percent copper, about 0.1 maximum percent vanadium, about 0.03 maximum percent yttrium, about 0.01 maximum percent platinum, less than about 0.001 percent oxygen, and/or about 0.001 percent nitrogen.

The present composition of matter may be used, for example, in articles having any operable crystalline structure, such as polycrystalline, directionally solidified, or single-crystal microstructures. However, its greatest advantages are achieved for single-crystal articles. Thus, an article comprises a substantially single crystal having a composition consisting essentially of, in weight percent, from about 1 to about 3 percent rhenium, from about 6 to about 9 percent aluminum, from 0 to about 0.5 percent titanium, from about 4 to about 6 percent tantalum, from about 12.5 to about 15 percent chromium, from about 3 to about 10 percent cobalt, from about 2 to about 5 percent tungsten, from 0 to about 0.2 percent hafnium, from 0 to about 1 percent silicon, balance nickel and minor elements. Other compatible features of the invention discussed elsewhere herein may be used in relation to such an article.

The article may be in the shape of a component of a gas turbine engine, such as a turbine blade, a turbine vane, a seal, or a stationary shroud.

The density of the present alloy is low, preferably less than about 0.305 pounds per cubic inch, and most preferably less than about 0.300 pounds per cubic inch. A low density is desirable both generally to save weight in a structure that is flown, and also specifically in those portions of the structure that rotate during service. A reduction in weight for a rotating structure allows a weight reduction for disks, shafts, bearings, and related structure as well. Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

BRIEF DESCRIPTION OF THE DRAWINGS

FIG. 5 is a graph of creep stress as a function of Larson-Miller parameter; and FIG. 6 is a graph of normalized stress versus normalized life in elevated temperature low-cycle fatigue testing.

DETAILED DESCRIPTION OF THE INVENTION

Figure 1:
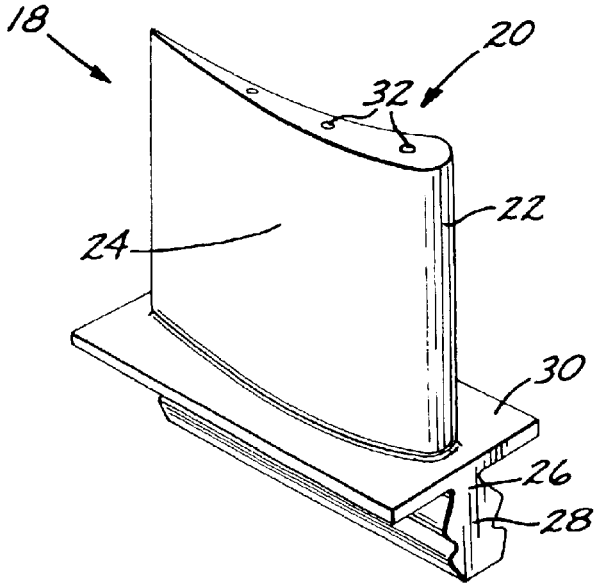
FIG. 1 is a perspective view of a gas turbine component, and specifically a turbine blade.

FIG. 1 depicts an article 18 in the form of a component 20 of a gas turbine engine, and in this case a substantially single crystal gas turbine blade 22. The present approach is operable with other articles, such as other components of the gas turbine engine, and the gas turbine blade 22 is presented as an example. Other components include turbine vanes (i.e., nozzles), seals, and stationary shrouds. The gas turbine blade 22 has an airfoil 24 against which the flow of hot combustion gas impinges during service operation, a downwardly extending shank 26, and an attachment in the form of a dovetail 28 which attaches the gas turbine blade 22 to a gas turbine disk (not shown) of the gas turbine engine. A platform 30 extends transversely outwardly at a location between the airfoil 24 and the shank 26. There may be internal cooling passages within the gas turbine blade 22, ending in outlet openings 32. During service, cooling air under pressure is introduced into the gas turbine blade 22 at its lower end through openings (not visible) in the dovetail 28, flows through the interior of the gas turbine blade 22 removing heat as it flows, and exits through the openings 32.

The composition of the present approach is a nickel-base superalloy. A nickel-base alloy has more nickel than any other elements. A nickel-base superalloy is a nickel-base alloy that is strengthened by the precipitation of gamma prime or a related phase.

The article 18 has the composition of the present approach, a composition consisting essentially of, in weight percent, from about 1 to about 3 percent rhenium, from about 6 to about 9 percent aluminum, from 0 to about 0.5 percent titanium, from about 4 to about 6 percent tantalum, from about 12.5 to about 15 percent chromium, from about 3 to about 10 percent cobalt, from about 2 to about 5 percent tungsten, from 0 to about 0.2 percent hafnium, from 0 to about 1 percent silicon, from 0 to about 0.25 percent molybdenum, from 0 to about 0.25 percent niobium, balance nickel and minor elements. (All compositions stated herein are in weight percent, unless specified to the contrary.) More preferably, the composition has from about 1.3 to about 2.0 percent rhenium, from about 6 to about 7 percent aluminum, from about 4.5 to about 5.5 percent tantalum, from about 12.5 to about 13.5 percent chromium, from about 7 to about 8 percent cobalt, from about 3.25 to about 4.25 percent tungsten, from about 0.1 to about 0.2 percent hafnium, and from about 0.03 to about 0.07 percent silicon.

It is preferred that the broad and specific compositions are limited to about 0.01 maximum percent boron, about 0.07 maximum percent carbon. about 0.03 percent maximum zirconium, about 0.01 percent maximum cerium, about 0.01 percent maximum lanthanum, about 0.04 percent maximum magnesium, about 0.001 maximum percent calcium, about 0.01 maximum percent manganese, about 0.005 maximum percent phosphorus, about 0.001 maximum percent sulfur, about 0.08 maximum percent iron, about 0.15 maximum percent molybdenum, about 0.15 maximum percent niobium, about 0.2 maximum percent copper, about 0.1 maximum percent vanadium, about 0.03 maximum percent yttrium, about 0.01 maximum percent platinum, less than about 0.001 percent oxygen, and about 0.001 percent nitrogen.

The elements present in the superalloy and their specific amounts interact cooperatively to produce the advantageous results associated with the composition of matter. Elements may not deviate substantially from the indicated ranges and amounts without the advantageous results being adversely affected.

The rhenium content is from about 1 to about 3 percent, preferably from about 1.3 to about 2.0 percent, more preferably from about 1.3 to about 1.9 percent, and most preferably about 1.6 percent. Rhenium is a potent solid solution strengthener. If the rhenium content is less than about 1 percent reduces the rupture strength, and more than about 3 percent promotes sigma-phase formation, which also reduces rupture strength by tying up rhenium in the TCP sigma phase.

The aluminum content is from about 6 to about 9 percent, preferably from about 6 to about 7 percent, more preferably from about 6.4 to about 6.8 percent, and most preferably about 6.6 percent. Aluminum is the main gamma-prime forming element to provide precipitation hardening and thence strength to the superalloy. If the aluminum content is below about 6 percent, the oxidation resistance and strength are reduced unacceptably, while above about 9 percent too much gamma-prime phase is formed, leading to reduced stability because sigma-phase formation is promoted.

The titanium content is from 0 to about 0.5 percent, preferably from 0 to about 0.1 percent, more preferably from 0 to about 0.04 percent, and most preferably 0. Titanium is avoided as much as possible because it impairs oxidation resistance.

The tantalum content is from about 4 to about 6 percent, preferably from 4.5 to about 5.5 percent, more preferably from about 4.8 to about 5.2 percent, and most preferably about 5.0 percent. Tantalum is a potent gamma-prime former, but it is a heavy element that adds substantially to the density of the superalloy. Tantalum is largely neutral to hot corrosion and oxidation-resistance. If the tantalum content is below about 4 percent, the rupture strength of the superalloy is compromised. If the tantalum content is above about 6 percent, there is a risk of instability in the formation of sigma phase because of the higher gamma-prime content.

The chromium content is from about 12.5 to about 15 percent, preferably from about 12.5 to about 13.5 percent, more preferably from about 12.75 to about 13.25 percent, and most preferably about 13 percent. Chromium is present to promote hot corrosion resistance by stabilizing aluminum oxide formation over an extended temperature range and tying up free sulfur. If the chromium content is below about 12.5 percent, the hot corrosion is reduced, and above about 15 percent chromium the oxidation resistance drops as the excessive chromium promotes the formation of mixed oxides rather than aluminum oxide, which is the principal oxide scale for oxidation resistance.

The cobalt content is from about 3 to about 10 percent, preferably from about 6 to about 8 percent, more preferably from about 7 to about 8 percent, and most preferably about 7.5 percent. Cobalt promotes stability and hot corrosion resistance. If the cobalt content is below about 3 percent, the stability and hot-corrosion resistance fall. If the cobalt content is above about 10 percent, oxidation resistance falls and the gamma-prime solvus temperature is reduced, thereby limiting elevated temperature rupture capability.

The tungsten content is from about 2 to about 5 percent, preferably from about 3.25 to about 4.25 percent, more preferably from about 3.5 to about 4.1 percent, and most preferably about 3.8 percent. Tungsten contributes to rupture strength, because it is an excellent solid-solution strengthener. If the tungsten content is less than about 2 percent, there is insufficient rupture strength. If the tungsten content is more than about 5 percent, there is potential for instability and also the hot corrosion resistance and oxidation resistance fall unacceptably.

The hafnium content is from 0 to about 0.2 percent, preferably from about 0.1 to about 0.2 percent, more preferably from about 0.12 to about 0.18 percent, and most preferably about 0.15 percent. Hafnium promotes stability of the aluminum oxide scale, thereby improving oxidation resistance. Higher levels increase the alloy density and promote the formation of gamma prime phase, which ultimately reduces alloy stability with respect to sigma-phase formation.

The silicon content is from 0 to about 1 percent, preferably from 0 to about 0.1 percent, more preferably from about 0.03 to about 0.07 percent, and most preferably about 0.05 percent. Silicon added in small amounts improves oxidation resistance. However, too great a silicon addition reduces the strength of the superalloy because of the precipitation of the weak beta phase.

Molybdenum and niobium are each present in an amount of from 0 to about 0.25 percent, preferably from 0 to about 0.15 percent, more preferably from 0 to about 0.1 percent, and most preferably 0. Molybdenum is a solution hardener in the gamma phase, and niobium replaces aluminum in gamma-prime phase, resulting in increased strength in each case. However, if the molybdenum and niobium contents are individually greater than that indicated, hot corrosion resistance is reduced, because in hot corrosion these elements dissolve in the sulfate melt and promote acidic fluxing.

Yttrium is preferably present in a maximum amount of about 0.03 percent, and most preferably is present in an amount of about 0.01 percent. Yttrium promotes aluminum scale stability and adherence. If a greater amount than about 0.03 percent is present, the excessive yttrium promotes undesirably mold-metal reaction at the casting surface and increases the inclusion content of the material.

Boron is preferably present in a maximum amount of about 0.01 percent, more preferably from about 0.003 to about 0.005 percent, and most preferably about 0.004 percent. Boron promotes grain boundary strength, particularly low-angle grain boundaries in single-crystal material. Greater amounts of boron promote incipient melting during solution heat treating.

Carbon is preferably present in a maximum amount of about 0.07 percent, more preferably from about 0.03 to about 0.06 percent, most preferably about 0.04 percent. Carbon is a deoxidizer present to reduce inclusions in the superalloy. Greater amounts of carbon reduce the strength of the superalloy by chemically combining with the hardening elements.

Zirconium is preferably present in a maximum amount of about 0.03 percent, and more preferably is present in an amount of 0. Zirconium strengthens grain boundaries that are present. However, for single-crystal articles zirconium is preferably present in as small an amount as possible.

Cerium and lanthanum are each preferably present in a maximum amount of about 0.01 percent to promote oxidation resistance. Greater amounts of these elements promote undesirable mold-metal chemical reaction at the casting surface and increase the inclusion content of the superalloy.

Magnesium is preferably present in a maximum amount of about 0.04 percent, and calcium is preferably present in a maximum amount of about 0.01 percent. These elements function as deoxidizers and also improve oxidation resistance in small quantities.

Manganese is preferably present in a maximum amount of about 0.01 percent; phosphorus is preferably present in a maximum amount of about 0.005 percent; sulfur is preferably present in a maximum amount of about 0.001 percent; iron is preferably present in a maximum amount of about 0.08 percent; copper is preferably present in a maximum amount of about 0.2 percent; vanadium is preferably present in a maximum amount of about 0.1 percent; platinum is preferably present in a maximum amount of about 0.01 percent; oxygen is preferably present in a maximum amount of about 0.001 percent; and nitrogen is preferably present in a maximum amount of about 0.001 percent.

Figure 2:
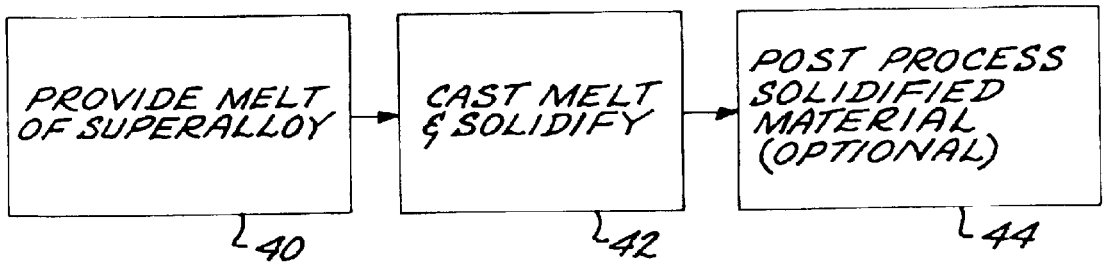
FIG. 2 is a block flow diagram of a preferred approach for making an article.

FIG. 2 is a block flow diagram of a preferred approach for making an article 18, such as the gas turbine blade 22, using the present approach. A melt (i.e., a molten mass) of the nickel-base superalloy having the composition set forth herein is provided, step 40. The melt is usually provided by melting pieces of the constituent elements in a vacuum furnace using melting practices known in the art for other nickel-base superalloys.

The melt is thereafter cast and solidified, numeral 42. The melt may be solidified to a cast article having approximately the final shape and dimensions of the article 18. Alternatively, the melt may be first cast as a cast article, and the cast article may be mechanically worked to the final shape and dimensions. The article 18 may be cast as substantially a single crystal structure, a directionally oriented multiple-crystal structure, or a polycrystalline structure. Casting techniques are known for achieving these crystal structures for other nickel-base superalloys, and those same casting techniques are utilized for the present nickel-base superalloys. It is preferred that the present nickel-base superalloy be used for casting articles that are substantially single crystal, because these materials are used at the highest temperatures and require the greatest combination of high-temperature mechanical and oxidation-resistance properties and intermediate-temperature hot corrosion resistance. "Substantially single crystal" and the like means the article is primarily of a single crystal (i.e, a single grain), although there may be small volumes of the material, typically not more than about 10 percent of the total volume, formed of other grains.

The article 18 is thereafter optionally post processed, step 44. Such post processing may include, for example, repairing casting defects, cleaning, heat treating, machining, applying protective coatings, and the like. The approaches to these post processing operations that are known for other nickel-base superalloys may be used for the present nickel-base superalloy as well.

The present invention has been reduced to practice and comparatively tested with commercially competitive alloys. A number of developmental melts and two production-scale heats were prepared. One of the production heats, designated Y1715, was comparatively tested for oxidation resistance, mechanical properties, and hot-corrosion resistance against competitive alloys. The Y1715 material had an analyzed composition, in weight percent, of 0.035 percent carbon, less than 0.01 percent manganese, 0.05 percent silicon, 0.003 percent phosphorus, 0.0002 percent sulfur, 12.99 percent chromium, 3.8 percent tungsten, 0.05 percent iron, 7.54 percent cobalt, less than 0.1 percent molybdenum, 6.64 percent aluminum, less than 0.01 percent titanium, less than 0.1 percent niobium, 4.9 percent tantalum, less than 0.01 percent zirconium, 0.003 percent boron, 0.1 percent copper, less than 0.1 percent vanadium, 0.14 percent hafnium, less than 0.0001 percent yttrium, 1.57 percent rhenium, 0.01 percent platinum, 0.0007 percent oxygen, 0.0003 percent nitrogen, and less than 100 ppmw magnesium, balance nickel and minor elements. The density of this alloy was about 0.299 pounds per cubic inch, as compared with a density of Rene™ N5 of about 0.312 pounds per cubic inch.

Figure 3:
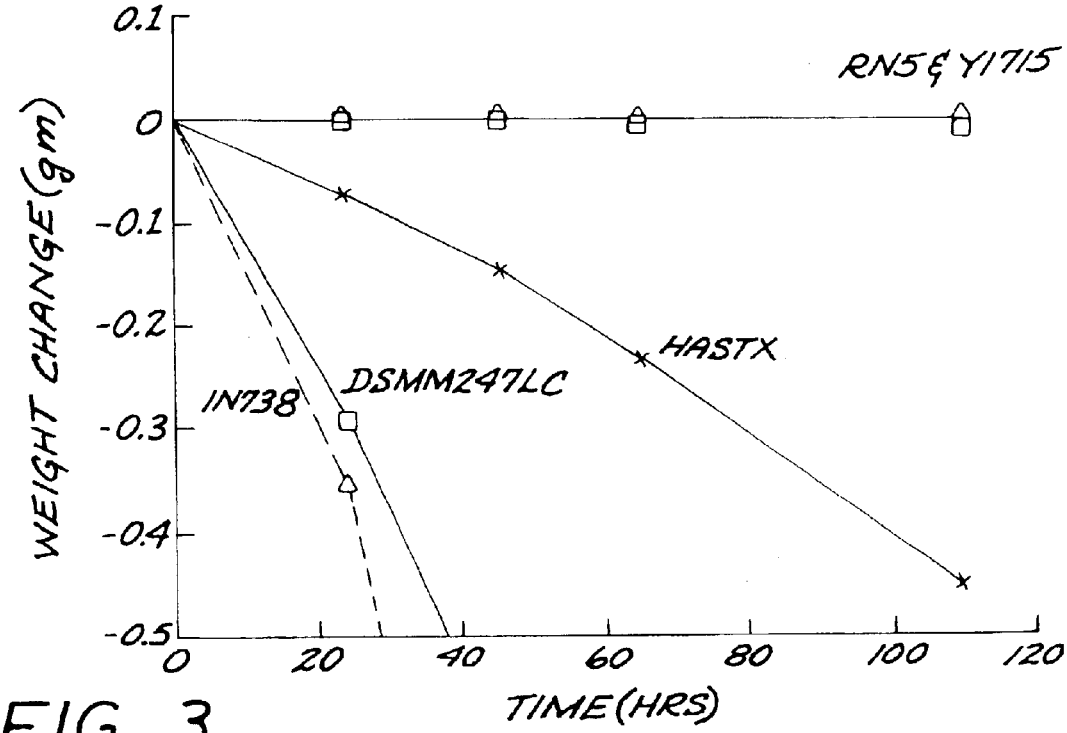
FIGS. 3 and 4 are plots of weight change during cyclic oxidation testing as a function of time, for two different test protocols.
Figure 4:
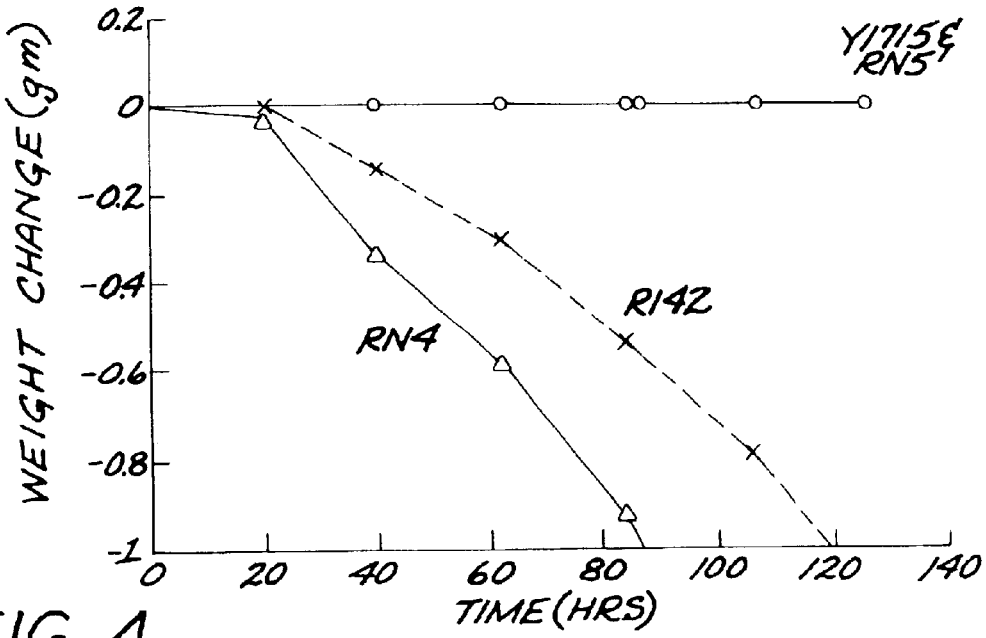

Mach 1 velocity oxidation testing was performed in a first test series at 2220° F. with one cycle per hour to room temperature, and in a second test series at 2150° F. with 20 cycles per hour to room temperature. Both tests utilized forced air cooling to room temperature using a compressed air blast. The baseline Rene™ N5 ("RN5") alloy and specimens of Y1715 alloy had substantially the same performance in each test. Comparison alloys IN 738, Hastelloy X ("HASTX"), and directionally solidified Mar M247LC ("DS MM247LC"), widely used gas turbine materials, exhibited inferior performance to both the Rene™ N5 and Y1715 alloys in the 2220° F. oxidation test, see FIG. 3. Comparison alloys Rene™ N4 ("RN4") and Rene™ 142, also both widely used gas turbine materials, exhibited inferior performance to both the Rene™ N5 and Y1715 alloys in the 2150° F. oxidation test, see FIG. 4.

Hot corrosion tests with 2 ppm (parts per million) sea salt contaminant were conducted on 0.130 inch diameter pins in a cyclic temperature test in which the specimens were cycled between 1500° F. and 1650° F. in a burner rig, with a saw-tooth ramp and one hour cycle time, for a total of 1039 hours in each case. After testing, the specimens were sectioned and the depth of total attack in inches per side was measured. The following table summarizes the results.

| Alloy | Total Attack (inches per side) |
|---|---|
| Y1715 | 0.002 |
| Y1715 | 0.002 |
| Y1715 | 0.002 |
| Rene 80 | 0.046 |
| Rene 80 | 0.058 |
| IN738 | 0.068 |
| IN738 | 0.069 |
| IN738 | 0.033 |
| IN738 | 0.020 |

The performance of Rene™ N5 alloy could not be measured in this test, as it corroded completely through and was completely destroyed in 350 hours, indicating 0.065 inches of attack per side at this point.

Stress rupture testing was performed over a range of temperatures, and the results are presented in standard Larson-Miller format in FIG. 5. At elevated temperatures, alloys Y1715 and Mar M247LC are substantially equivalent in stress rupture performance. This result is significant, because the Y1715 alloy has a density of 0.299 pounds per cubic inch, while the Mar M247 has a higher density of 0.308 pounds per cubic inch. The Y1715 alloy has an 1800° F./100 hour rupture stress of about 30,000 pounds per square inch, significantly better than would be expected for an alloy with chromium in the 13 percent range.

FIG. 6 depicts the low-cycle-fatigue capability of alloy Y1715 as compared with that of Rene™ N5 alloy, with the fatigue parameter A=−1 and a 2 minute hold time. The Y1715 alloy is stronger than the Rene™ N5 alloy, even though the density of Y1715 alloy is 0.299 pounds per cubic inch and the density of Rene™ N5 alloy is 0.312 pounds per cubic inch.

For alloy designers, balancing rupture strength with oxidation and hot corrosion resistance is difficult, because some elemental additions which enhance one property may degrade another. Chromium is an example. Chromium may be added to promote hot corrosion resistance, but chromium is not an effective solution strengthener compared to the heavier refractory elements molybdenum, tungsten, and rhenium. Thus, many alloys reduce the chromium content at the expense of these more-effective strengthening elements.

An additional problem facing the alloy designer is the successful coupling of oxidation and hot corrosion resistance. Alloys recognized for their corrosion resistance include Rene™ 80, IN 738, and IN 792. These alloys have a chromium content of more than about 12.5 percent, and an aluminum/titanium ratio of 1 or less. The levels of titanium and chromium allow the alloy to form $Cr_2O_3$ and $TiO_2$ in the hot-corrosion temperature range to forestall corrosion. The composition also provides useful strength characteristics up to about 2000° F.

Rene™ N5 provides outstanding strength and oxidation resistance above about 2000° F. Its composition allows the alloy to readily form a protective layer of aluminum oxide for oxidation protection. However, the hot corrosion resistance of Rene™ N5 lags that of Rene™ 80, IN 738, and IN 792, because the aluminum level is too low to provide protection at lower temperatures. Additionally, the chromium level is deliberately limited for strength, stability, and oxidation requirements. Since Rene™ N5 is designed for strength above about 2000° F., chromia formation is not desirable due to its volatilization in this high-temperature range. The chromium content of Rene™ N5 is therefore limited to about 7 percent by weight.

As demonstrated by the test results, the present composition provides a good balance in mechanical properties, oxidation properties, and corrosion properties. Many gas turbine components such as nozzles (vanes) and shrouds are not stress-rupture limited. These components must resist erosion from the combined effects of hot corrosion and oxidation, and low-cycle-fatigue damage from thermal cycling. The present alloy, as exemplified by alloy Y1715, meets these criteria and is unique in its property balance.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A composition of matter consisting essentially of, in weight percent, from about 1 to about 3 percent rhenium, from about 6 to about 9 percent aluminum, from 0 to about 0.5 percent titanium, from about 4 to about 6 percent tantalum, from about 12.5 to about 15 percent chromium, from about 3 to about 10 percent cobalt, from about 2 to about 5 percent tungsten, from 0 to about 0.2 percent hafnium, from 0 to about 1 percent silicon, from 0 to about 0.25 percent molybdenum, from 0 to about 0.25 percent niobium, balance nickel and minor elements.

2. The composition of matter of claim 1, wherein the composition of matter has from about 1.3 to about 2.0 percent rhenium, from about 6 to about 7 percent aluminum, from about 4.5 to about 5.5 percent tantalum, from about 12.5 to about 13.5 percent chromium, from about 7 to about 8 percent cobalt, from about 3.25 to about 4.25 percent tungsten, from about 0.1 to about 0.2 percent hafnium, and from about 0.03 to about 0.07 percent silicon.

3. The composition of matter of claim 1, wherein the composition of matter has about 1.6 percent rhenium, about 6.6 percent aluminum, less than about 0.1 percent titanium, about 5 percent tantalum, about 13 percent chromium, about 7.5 percent cobalt, about 3.8 percent tungsten, about 0.15 percent hafnium, and less than about 0.1 percent silicon.

4. The composition of matter of claim 1, wherein the composition of matter is limited to about 0.01 maximum percent boron, about 0.07 maximum percent carbon, about 0.03 percent maximum zirconium, about 0.01 percent maximum cerium, about 0.01 percent maximum lanthanum, about 0.04 percent maximum magnesium, and about 0.001 maximum percent calcium.

5. The composition of matter of claim 4, wherein the composition of matter has about 1.6 percent rhenium, about 6.6 percent aluminum, less than about 0.1 percent titanium, about 5 percent tantalum, about 13 percent chromium, about 7.5 percent cobalt, about 3.8 percent tungsten, about 0.15 percent hafnium, and less than about 0.1 percent silicon.

6. The composition of matter of claim 1, wherein the composition of matter is limited to about 0.01 maximum percent manganese, about 0.005 maximum percent phosphorus, about 0.001 maximum percent sulfur, about 0.08 maximum percent iron, about 0.15 maximum percent molybdenum, about 0.15 maximum percent niobium, about 0.2 maximum percent copper, about 0.1 maximum percent vanadium, about 0.0001 maximum percent yttrium, about 0.01 maximum percent platinum, less than about 0.001 percent oxygen, and about 0.001 percent nitrogen.

7. The composition of matter of claim 1, wherein the composition of matter has a density of less than about 0.305 pounds per cubic inch.

8. A composition of matter consisting essentially of, in weight percent, from about 1 to about 3 percent rhenium, from about 6 to about 9 percent aluminum, from 0 to about 0.5 percent titanium, from about 4 to about 6 percent tantalum, from about 12.5 to about 15 percent chromium, from about 3 to about 10 percent cobalt, from about 2 to about 5 percent tungsten, from 0 to about 0.2 percent hafnium, from 0 to about 1 percent silicon, from 0 to about 0.25 percent molybdenum, from 0 to about 0.25 percent niobium, about 0.01 maximum percent boron, about 0.07 maximum percent carbon, about 0.03 percent maximum zirconium, about 0.01 percent maximum cerium, about 0.01 percent maximum lanthanum, about 0.04 percent maximum magnesium, about 0.001 maximum percent calcium, balance nickel and minor elements.

9. The composition of matter of claim 8, wherein the composition of matter has from about 1.3 to about 2.0 percent rhenium, from about 6 to about 7 percent aluminum, from about 4.5 to about 5.5 percent tantalum, from about 12.5 to about 13.5 percent chromium, from about 7 to about 8 percent cobalt, from about 3.25 to about 4.25 percent tungsten, from about 0.1 to about 0.2 percent hafnium, and from about 0.03 to about 0.07 percent silicon.

10. The composition of matter of claim 8, wherein the composition of matter has about 1.6 percent rhenium, about 6.6 percent aluminum, less than about 0.1 percent titanium, about 5 percent tantalum, about 13 percent chromium, about 7.5 percent cobalt, about 3.8 percent tungsten, about 0.15 percent hafnium, and less than about 0.1 percent silicon.

11. The composition of matter of claim 8, wherein the composition of matter has a density of less than about 0.305 pounds per cubic inch.

12. An article comprising a substantially single crystal having a composition consisting essentially of, in weight percent, from about 1 to about 3 percent rhenium, from about 6 to about 9 percent aluminum, from 0 to about 0.5 percent titanium, from about 4 to about 6 percent tantalum, from about 12.5 to about 15 percent chromium, from about 3 to about 10 percent cobalt, from about 2 to about 5 percent tungsten, from 0 to about 0.2 percent hafnium, from 0 to about 1 percent silicon, from 0 to about 0.25 percent molybdenum, from 0 to about 0.25 percent niobium, balance nickel and minor elements.

13. The article of claim 12, wherein the composition has from about 1.3 to about 2.0 percent rhenium, from about 6 to about 7 percent aluminum, from about 4.5 to about 5.5 percent tantalum, from about 12.5 to about 13.5 percent chromium, from about 7 to about 8 percent cobalt, from about 3.25 to about 4.25 percent tungsten, from about 0.1 to about 0.2 percent hafnium, and from about 0.03 about 0.07 percent silicon.

14. The article of claim 12, wherein the composition has about 1.6 percent rhenium, about 6.6 percent aluminum, less than about 0.1 percent titanium, about 5 percent tantalum, about 13 percent chromium, about 7.5 percent cobalt, about 3.8 percent tungsten, about 0.15 percent hafnium, and less than about 0.1 percent silicon.

15. The article of claim 12, wherein the composition is limited to about 0.01 maximum percent boron, about 0.07 maximum percent carbon, about 0.03 percent maximum zirconium, about 0.01 percent maximum cerium, about 0.01 percent maximum lanthanum, about 0.04 percent maximum magnesium, and about 0.001 maximum percent calcium.

16. The article of claim 15, wherein the composition has about 1.6 percent rhenium, about 6.6 percent aluminum, less than about 0.1 percent titanium, about 5 percent tantalum, about 13 percent chromium, about 7.5 percent cobalt, about 3.8 percent tungsten, about 0.15 percent hafnium, and less than about 0.1 percent silicon.

17. The article of claim 12, wherein the composition is limited to about 0.01 maximum percent manganese, about 0.005 maximum percent phosphorus, about 0.001 maximum percent sulfur, about 0.08 maximum percent iron, about 0.15 maximum percent molybdenum, about 0.15 maximum percent niobium, about 0.2 maximum percent copper, about 0.1 maximum percent vanadium, about 0.0001 maximum percent yttrium, about 0.01 maximum percent platinum, less than about 0.001 percent oxygen, and about 0.001 percent nitrogen.

18. The article of claim 12, wherein the substantially single crystal is in the shape of a component of a gas turbine engine.

19. The article of claim 12, wherein the substantially single crystal is in the shape of a component of a gas turbine engine selected from the group consisting of a turbine blade, a turbine vane, a seal, and a stationary shroud.

20. The article of claim 12, wherein the article has a density of less than about 0.305 pounds per cubic inch.

* * * * *